United States Patent [19]

Yuhara et al.

[11] Patent Number: 4,834,122

[45] Date of Patent: May 30, 1989

[54] VANITY CASE

[75] Inventors: Yukitomo Yuhara, Abiko; Yoshiharu Hatakeyama, Tokyo, both of Japan

[73] Assignee: Yoshida Industry Co., Ltd., Tokyo, Japan

[21] Appl. No.: 163,851

[22] Filed: Mar. 3, 1988

[30] Foreign Application Priority Data

May 21, 1987 [JP] Japan ..... 62-75181[U]
May 22, 1987 [JP] Japan ..... 62-76146[U]
Aug. 24, 1987 [JP] Japan ..... 62-127402[U]

[51] Int. Cl.[4] ..... A45D 33/00
[52] U.S. Cl. ..... 132/301; 132/293
[58] Field of Search ..... 132/293, 294, 295, 296, 132/301, 303

[56] References Cited

U.S. PATENT DOCUMENTS

| | | | |
|---|---|---|---|
| 4,276,893 | 7/1981 | Enomoto et al. | 132/301 |
| 4,331,168 | 5/1982 | Hatakeyama | 132/316 |
| 4,366,829 | 1/1983 | Yuhara | 132/301 |
| 4,387,730 | 6/1983 | Shioi | 132/301 |
| 4,392,503 | 7/1983 | Watanabe | 132/301 |
| 4,399,826 | 8/1983 | Ogasawara | 132/301 |
| 4,474,196 | 10/1984 | Yuhara | 132/301 |
| 4,483,355 | 11/1984 | Yuhara | 132/301 |
| 4,595,028 | 6/1986 | Yuhara | 132/314 |
| 4,679,576 | 7/1987 | Yuhara et al. | 132/293 |
| 4,681,127 | 7/1987 | Gueret | 132/301 |
| 4,683,899 | 8/1987 | Yuhara et al. | 132/293 |
| 4,685,558 | 8/1987 | Filiz | 132/301 |
| 4,696,317 | 9/1987 | Shioi et al. | 132/314 |

FOREIGN PATENT DOCUMENTS 61-143502 7/1986 Japan .

*Primary Examiner*—Paul J. Hirsch
*Attorney, Agent, or Firm*—Wenderoth, Lind & Ponack

[57] ABSTRACT

In a vanity case comprising a receptacle member, a cover member hinged with the receptacle member, and latch members for maintaining the cover member in a closed position, a cutout is formed in the marginal portion of the receptacle member and defined by an inner wall and side walls. A slide member includes an upper end and a body having a lower end, the upper end being slidably secured to the cover member and the body extending downwardly to close the cutout with the lower end abutting the inner wall of the cutout when the cover member is in the closed position. A slant surface is formed on at least one of the inner wall and the lower end, whereby a sliding movement of the slide member causes the cover member to move upwardly.

13 Claims, 9 Drawing Sheets

VANITY CASE

BACKGROUND OF THE INVENTION

1. Field of the Invention

The present invention relates to a vanity case of the type in which a receptacle member and a cover member are hinged together at the respective rear ends and the cover member is maintained in a closed position with respect to the receptacle member by engagement of latch means formed on the front ends of both members.

2. Description of the Prior Art

Various attempts and efforts have hitherto been made in order to facilitate an opening operation of the cover member, and a push piece has been proposed and found effective. For example, U.S. Pat. Nos. 4,276,893 and 4,399,826 disclose such a push piece arranged in a recess formed on the marginal portion of the receptacle member in a slidable manner (U.S. Pat. No. 4,276,893) or in a rotatable manner (U.S. Pat. No. 4,399,826) so that an inwardly directed pressure applied to the push piece urges the cover member upwardly to thereby release the engagement of latch means. In order to open the cover member, the push piece is pressed by, for example, the thumb of one hand, which releases the engagement of the latch means. Then the front end of cover member is lifted up by using the other hand or by shifting the thumb to the front edge of the cover. It is thus necessary to use both hands or to do a two-step operation in opening the cover.

U.S. Pat. No. 4,331,168 discloses an arrangement of the push piece in the cover member, whereby the cover member can be opened by the same finger which has pressed the push piece. In this vanity case, however, a portion of the push piece to be pressed is located just above the upper edge of the receptacle member so that the lower end of the finger which has pressed the push piece tends to come into contact with the upper edge of receptacle, resulting in a difficulty in lifting up the cover by the same finger without shifting this. In order to avoid the contact a delicate operation is required in positioning the finger onto the push piece.

Accordingly, an object of the present invention is to provide a vanity case having a push piece which can be pressed by a user's finger without delicate positioning of the finger.

Another object of the invention is to provide a vanity case in which a cover member can be opened to a desired angle by the same finger as pressing a push piece without shifting that finger.

SUMMARY OF THE INVENTION

According to the present invention, a vanity case include a receptacle member, a cover member hinged with the receptacle member at the rear end thereof, a first latch member formed on the receptacle member, a second latch member formed on the cover member and adapted to engage with the first latch member for maintaining the cover member in a closed position with respect to the receptacle member. A cutout is formed in the marginal portion of the receptacle member, and defined by an inner wall and side walls. A slide member for releasing the engagement of the latch members is provided which includes an upper end and a body having a lower end. The upper end is slidably secured to the cover member, while the body extends downwardly to close the cutout with the lower end abutting the inner wall when the cover member is in closed position. A slant surface is formed on at least one of the inner wall of the cutout and the lower end of the body, whereby a sliding movement of the slide member causes the cover member to move upwardly with respect to the receptacle member.

In an embodiment of the invention, a recess is formed in the cover member at a position corresponding to the cutout and the upper end of the slide member is slidably fitted in the recess. A lug may extend between the side walls defining the recess and a step may be formed on the upper surface of the recess, while the upper end of the slide member may include an enlarged head that normally engaging with the lug and the step.

Other objects, features and advantages of the invention will be apparent from the following detailed description thereof when taken in conjunction with the accompanying drawings.

DETAILED DESCRIPTION OF THE INVENTION

Figure 1:
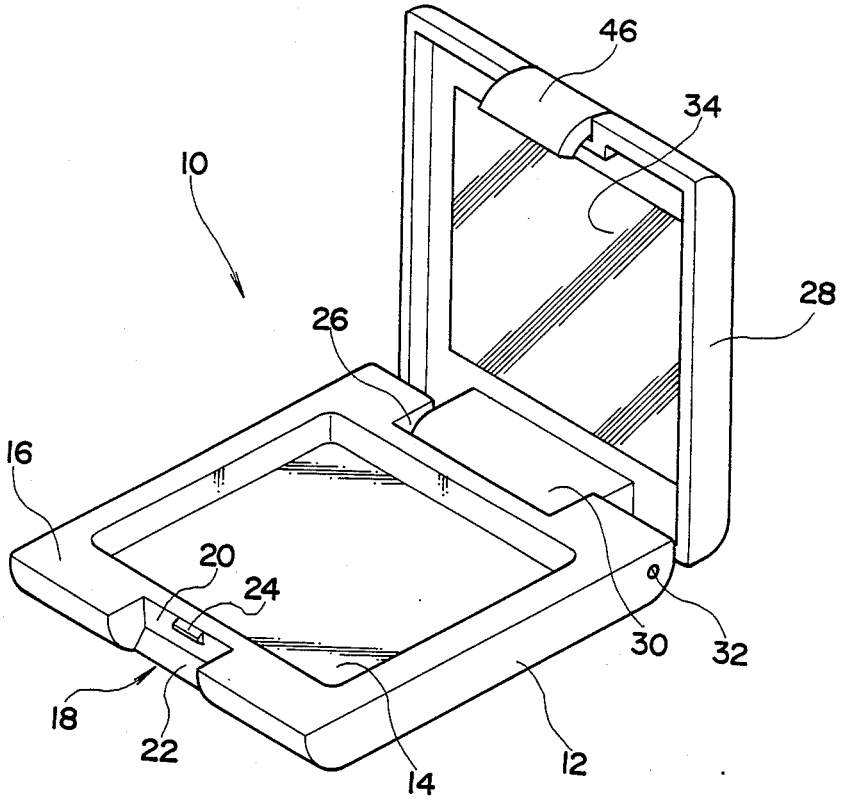
FIG. 1 is a perspective view showing a vanity case according to a first embodiment of the present invention with a cover member open.
Figure 2:
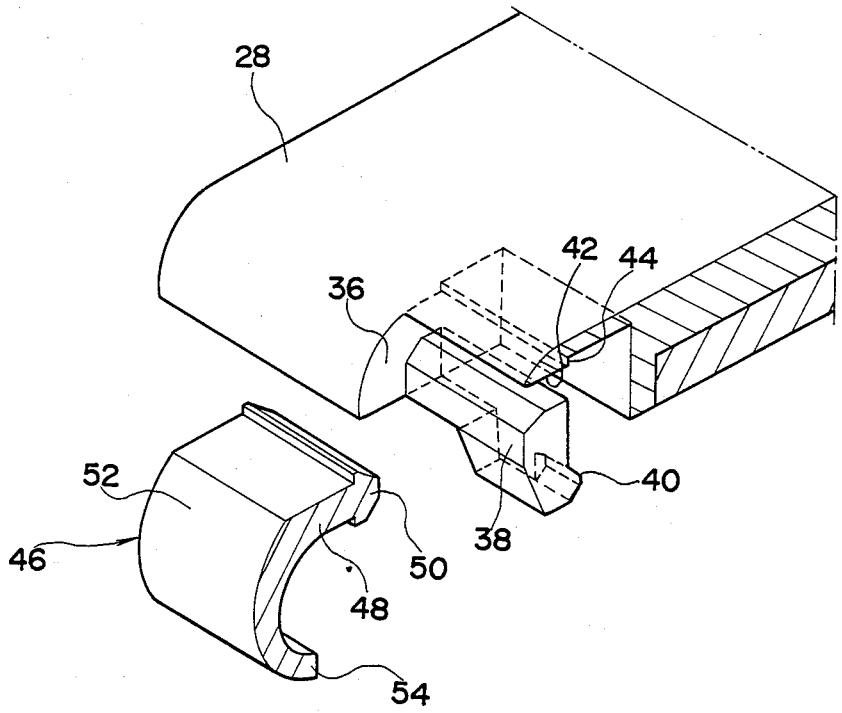
FIG. 2 is an enlarged perspective view showing a slide member before fitted into the cover member.
Figure 3:
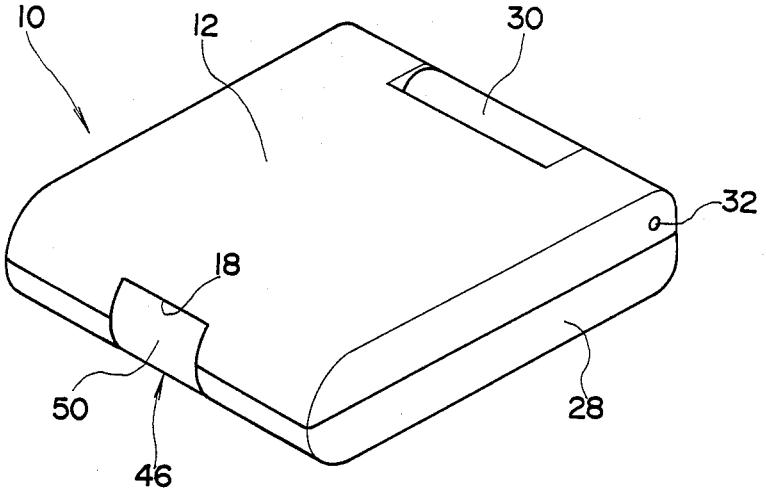
FIG. 3 is a perspective view as seen from the bottom of the vanity case of FIG. 1 with the cover member closed.

Referring first to FIGS. 1 to 4 of the drawings, a vanity case 10 comprises a receptacle member 12 having a concave portion 14 formed on the upper surface of the receptacle for containing cosmetic material. In the central portion of the front end of the receptacle 12 is formed a cutout 18 which opens onto the upper surface, front end, and underside. Thus, the cutout 18 is defined by a pair of side walls and an inner wall comprising an upper vertical surface 20 and a lower slant surface 22 inclined toward the front end. On the vertical surface 20 is integrally formed a first latch tongue 24. In the center of the rear end of the receptacle 12 is formed a groove 26 into which is fitted a hinge piece 30 of a cover member 28, and the hinge piece 30 is hinged with the receptacle 12 by a pin 32.

A mirror 34 is adhered to the lower surface of the cover 28. The front end of the cover 28 is centrally cut away to form a recess 36 and a lug 38 extends between the side walls defining the recess 36. The lug 38 extends downwardly to form a second latch tongue 40 projecting inwardly. The second latch tongue 40 is adapted to engage with the first latch tongue 24 when the cover 28 is closed over the receptacle 12 with the lug 38 fitted into the cutout 18, the cover 28 being latched to the receptacle 12.

Figure 4:
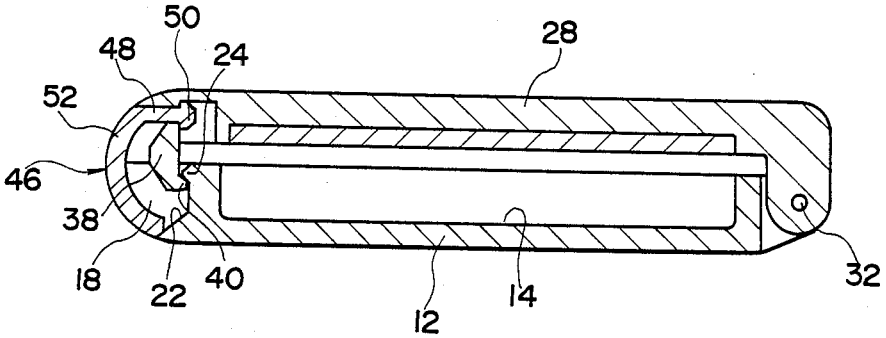
FIG. 4 is a longitudinal sectioned view thereof.

A gap 42 of uniform width is defined between the upper surface of the recess 36 and the lug 38, and the recess 36 is upwardly enlarged by a step 44 formed on the upper surface. A slide member 46 of relatively hard plastic material comprises a horizontal portion 48 which slides through the gap 42. A head 50 of the portion 48 has a cross section in the form of an arrow and is forcedly inserted into the inner space of the recess 36 through the gap 42 to engage with the step 44 so that the slide member 46 is unremovably secured to the cover 28. When secured, an inner end of the head 50 is spaced from the inner wall defining the recess 36 as shown in FIG. 4 sufficiently to permit the head 50 (and therefore the slide member 46) to slide relative to the cover 28. The slide member 46 also comprises a round body 52 which, when the vanity case is closed, extends generally downwardly in such a manner that it closes the recess 36 and the cutout 18, and that the lower end 54 of the slide member 46 abuts against the slant surface 22 of the cutout 18 at the lower edge thereof which is positioned at the level of the bottom surface of receptacle 12 as seen from FIG. 3. The round body 52 of the slide member 46 has the same curvature as the front end walls of the receptacle 12 and the cover 28 so as to be flush with these end walls when the vanity case is closed.

Figure 5:
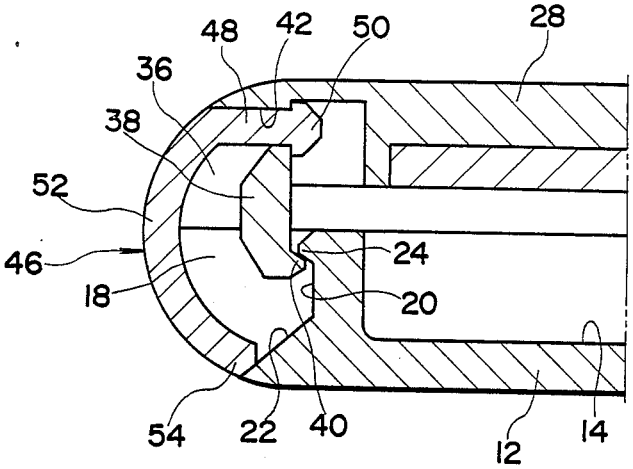
FIG. 5 is an enlarged fragmentary view thereof.
Figure 6:
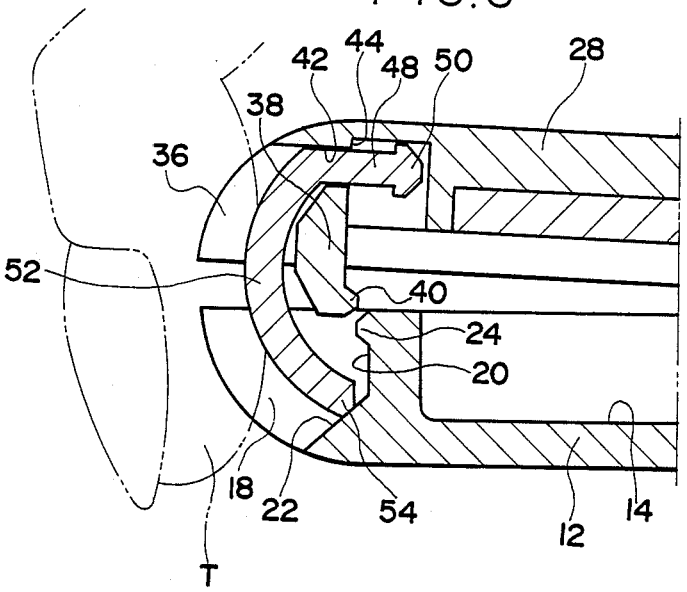
FIG. 6 is a view similar to FIG. 5 showing an operation of the slide member.

In order to open the vanity case 10 from closed position as shown in FIGS. 4 and 5, the round body 52 of the slide member 46 is pushed inward with a user's finger such as the thumb T, which causes the lower end 54 of the slide member 46 to slide upon the slant surface 22, and the horizontal portion 48 to slide through the gap 42. As the lower end 54 slides up on the slant surface 22, upward force is applied to the cover 28 to which the slide member 46 is secured, so that the second latch tongue 40 is disengaged from the first latch tongue 24 to slightly open the cover 28 as shown in FIG. 6. Then, the cover 28 is opened to any desired angle by pushing the slide member 46 upward with the same finger. The usual closing operation will cause the second latch tongue 40 to snap into engagement with the first latch tongue 24.

During the above opening operation, a user may first put her finger onto the front end, i.e. longitudinal center, of the round body 52 and then apply an inwardly directed force thereto through that finger. Since the slide member 46 extends substantially throughout the thickness of the vanity case, no delicate work is required to locate the finger in position. After the engagement between the latch tongues 24 and 40 is released, a user can open the cover 28 simply by changing the direction of force applied to the slide member without being prevented by the receptacle 12.

Figure 7:
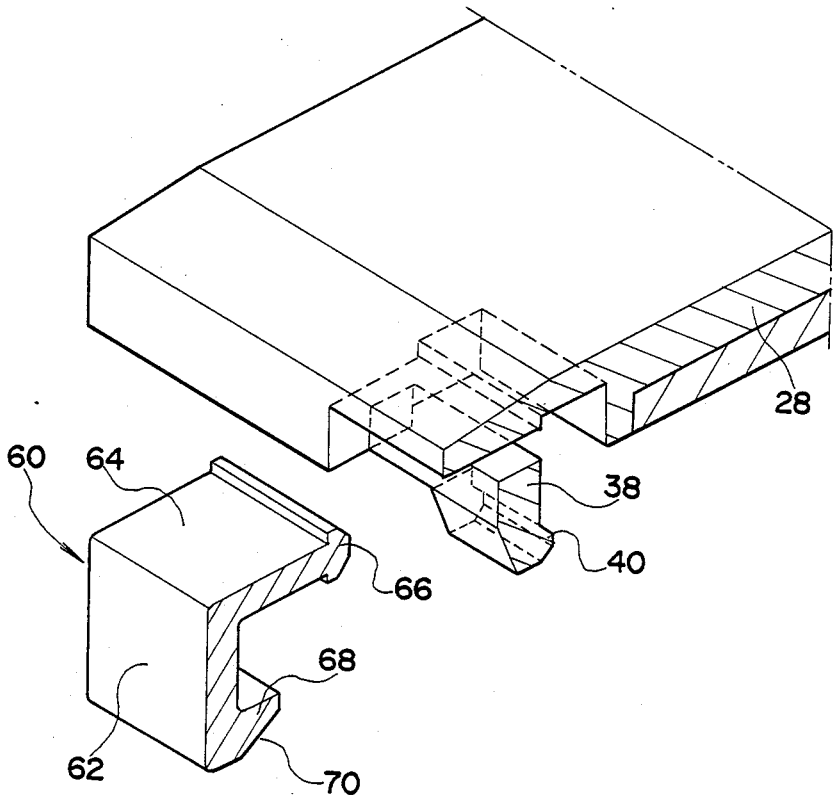
FIG. 7 is an enlarged perspective view showing a slide member of a vanity case according to a second embodiment of the present invention before fitted into a cover member.
Figure 8:
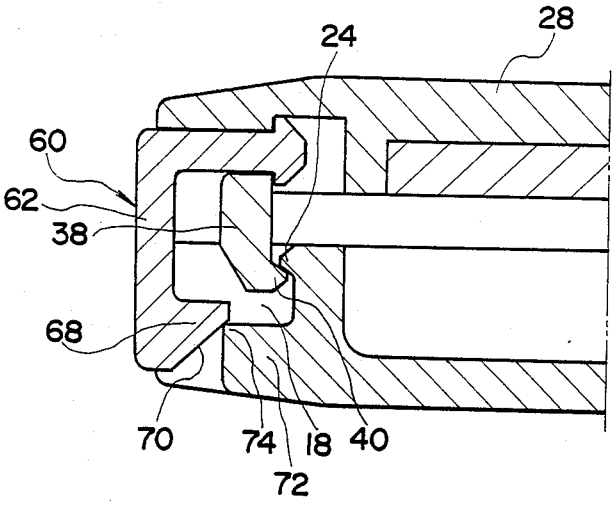
FIG. 8 is a fragmentary sectional view of the vanity case of FIG. 7.
Figure 9:
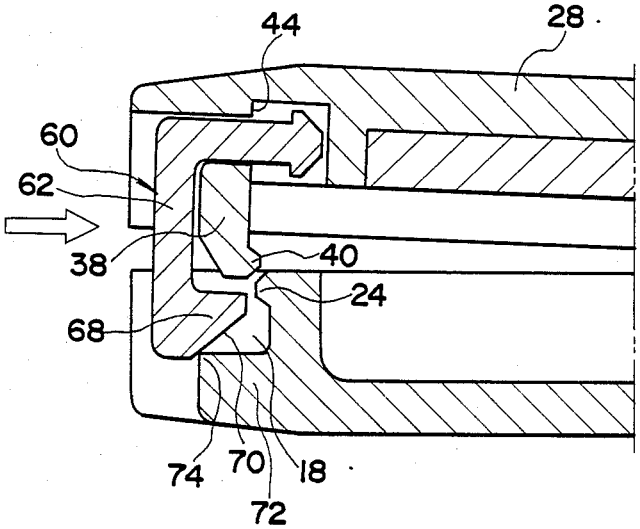
FIG. 9 is a similar view to FIG. 8 showing an operation of the slide member.

In a second embodiment shown in FIGS. 7 to 9, a slide member 60 has a downward extending portion 62 which is perpendicular to a horizontal portion 64 having a head 66, and the lower end of which projects inward. This projection 68 has a lower slant surface 70 inclined upward toward the inside. The slant surface 70 faces and abuts against an angled corner 74 of a protrusion 72 formed on the inner wall defining the cutout 18 of the receptacle 12. The protrusion 72 may alternately include an inclined upper surface to cooperate with the slant surface 70. Other structures of this embodiment are substantially the same as those of the first embodiment.

In order to open the vanity case from closed position as shown in FIG. 8, the portion 62 of the slide member 60 is pressed inward as shown in FIG. 9. As the slide member 60 is moved inward, the slant surface 70 slides upward on the angled corner 74, which applies upward force to the cover 28 for causing the first latch tongue 24 to disengage from the second latch tongue 40. Then, the cover 28 is opened to a desired angle simply by pressing the slide member 60 upwardly with that finger in the same manner as in the first embodiment.

Figure 10:
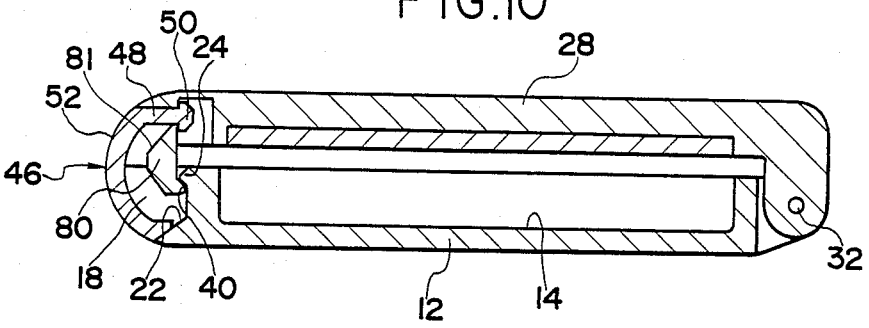
FIG. 10 is a longitudinal section of a vanity case according to a third embodiment of the present invention with a cover member closed.
Figure 11:
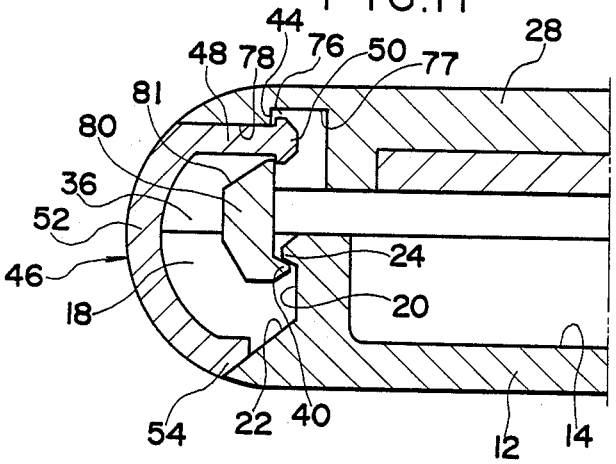
FIG. 11 is an enlarged fragmentary view thereof.
Figure 12:
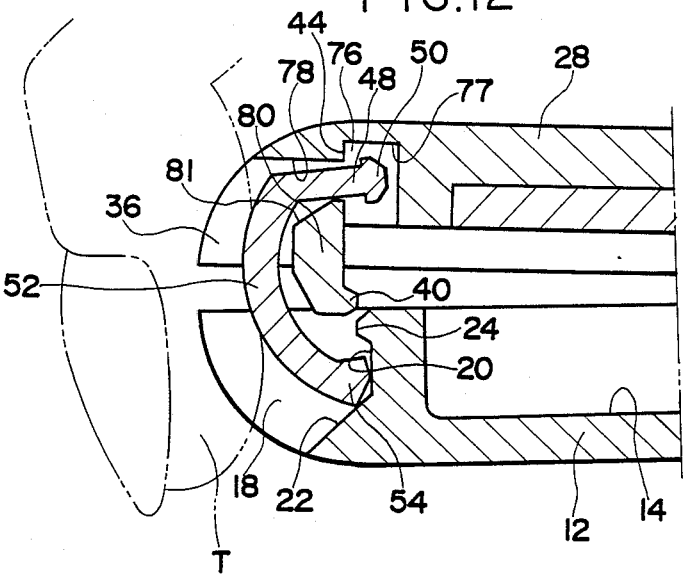
FIG. 12 is a view similar to FIG. 11 showing an operation of a slide member.
Figure 13:
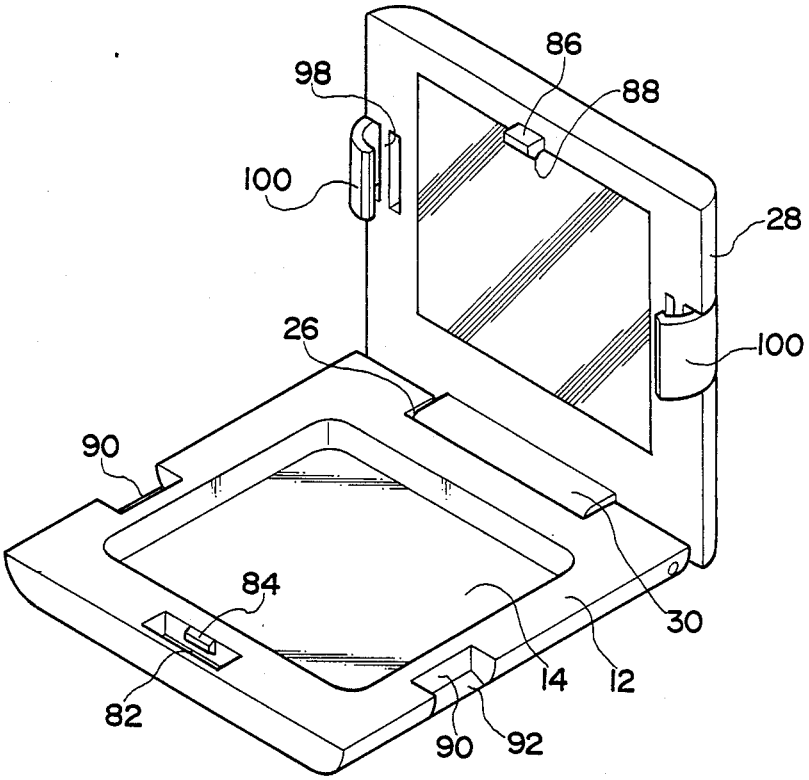
FIG. 13 is a perspective view showing a vanity case according to a fourth embodiment of the present invention with a cover member open.
Figure 14:
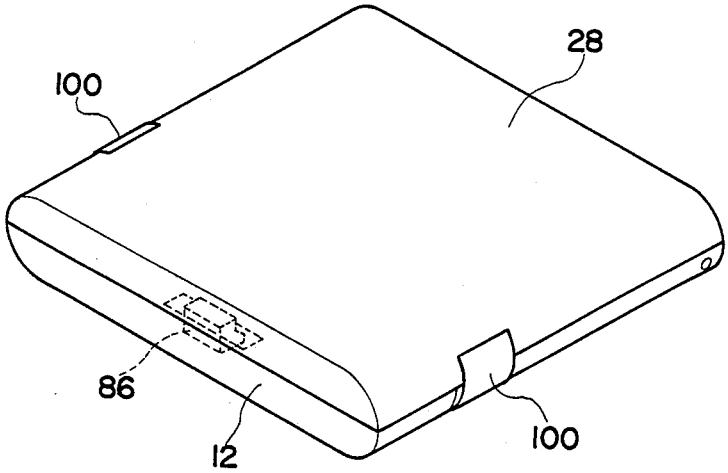
FIG. 14 is also a perspective view thereof with the cover member closed.
Figure 15:
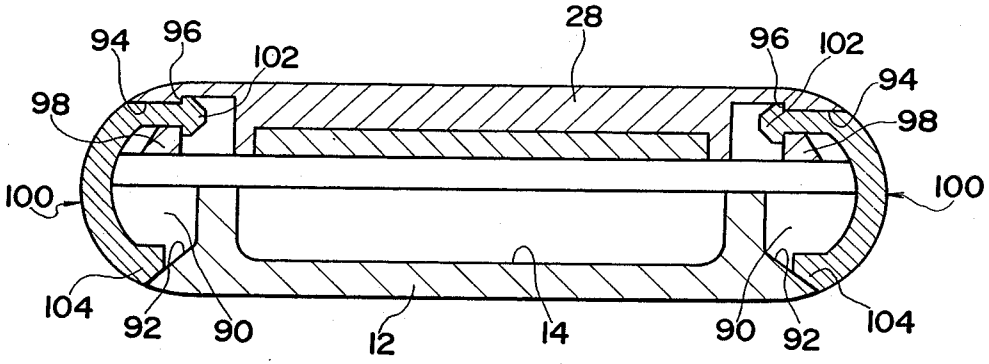
FIG. 15 is a transverse section thereof.
Figure 16:
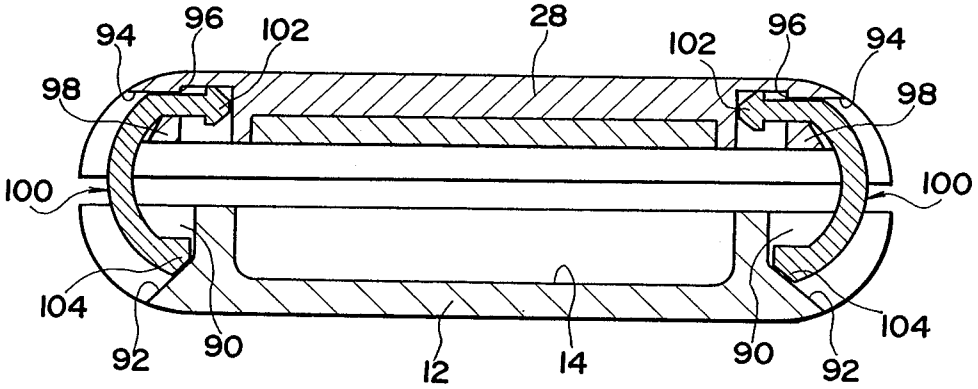
FIG. 16 is a similar view to FIG. 15 showing an operation of slide members.
Figure 17:
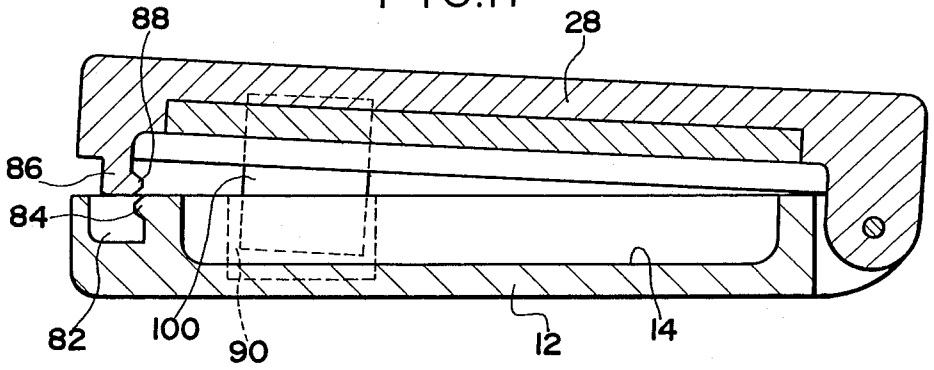
FIG. 17 is a longitudinal section of the vanity case of FIG. 13 with the cover member being in a position of FIG. 16.

FIGS. 10 through 12 show a third embodiment of the vanity case according to the present invention, which is generally similar to the first embodiment except as follows. In this embodiment, a lug 80 extending between side walls of the recess 36 in the cover 28 has an upper surface 81 which is inclined downwardly toward the open end of the recess 36 to define an inwardly tapered gap 78 in cooperation with the upper flat surface of the recess 36. The horizontal portion 48 of the slide member 46 is loosely fitted in the gap 78 with its head 50 engaging with the step 44 so as to secure the slide member 46 to the cover 28 in the slidable manner. The step 44 is, when compared with the first embodiment, elongated to the upward direction whereby a clearance 76 is formed between the upper edge of the head 50 and the stepped upper surface 77 of the recess 36. This clearance 76 operates with the tapered gap 78 to permit the slide member 46 also to swing when a pressure is applied to the latter.

When it is desired to open the cover 28, a user's finger is put onto the round body 52 of slide member 46 to apply a pressure thereto in upward and inward directions. This pressure causes the slide member 46 first to move inwardly with the portion 48 sliding in the gap 78. Then, as the lower end 54 of the body 52 slides up on the slant surface 22, the slide member 46 swings in the recess 36 in a counterclockwise direction as seen in FIG. 12. These combined movements of the slide member 46 applies an upwardly directed reaction force to the cover 28 through the portion 48 and the head 50, resulting in releasing the engagement between the first and second latch tongues 24 and 40. Thereafter, the user can open the cover 28 to a desired angle simply by applying the pressure to the body 50 continuously. It should be noted that the pressure required for releasing the engagement between the latch tongues 24 and 40 is substantially in the same direction as the force for opening the cover 28, which unnecessitates even changing the direction of pressure applied to the slide member 46.

FIGS. 13 through 17 show a fourth embodiment of the vanity case according to the present invention, which has two slide members disposed at the respective sides unlike the above three embodiments in which the slide member is disposed at the front marginal portion. In this embodiment, the receptacle 12 includes at its front marginal portion a depression 82 in which a first latch tongue 84 is formed. A nose 86 extends downward from the front lower surface of the cover 28, and includes a second latch tongue 88 which snaps into engagement with the first latch tongue 84 when the cover 28 is closed over the receptacle 12.

Symmetrical cutouts 90—90 are formed in the side walls of the receptacle 12 and each partly defined by a slant surface 92 ascending toward the inside. The cutout 90 is similar to the cutout 18 of FIG. 1 except that no latch tongue is provided on the inner wall. At the portions of the cover 28 opposite the cutouts 90—90 are formed recesses 94—94 extending horizontally toward the inside, each recess 94 including a step 96 and a bar or lug 98 for engaging with a head 102 of a slide member 100. As in the first embodiment, each slide member 100 has a round body which closes the cutout 90 and the recess 94 with its external surface being flush with the side walls of the receptacle 12 and the cover 28 and its lower end 104 abutting the lower end of the slant surface 92 defining the cutout 90, when the cover 28 is closed over the receptacle 12.

In order to open the vanity case, the round bodies of the slide members 100—100 are pushed inward with, for example, the thumb and forefinger, which causes the lower ends 104—104 of the bodies to slide up on the slant surfaces 92—92 as the heads 102 to slide through the gaps over the lugs 98—98. As the lower ends 104-104 slide up on the slant surfaces 92—92, upward force is applied to the cover 28 at both sides thereof so that the second latch tongue 88 is disengaged from the first latch tongue 84 at the front end of the vanity case. Then, the cover 28 can be opened to a desired angle by lifting up the slide members 100 with the same fingers.

Although it is preferable to form the slide members at both sides of the vanity case as in the illustrated embodiment, a single slide member at one side of the vanity case may be sufficient for the same function.

Figure 18:
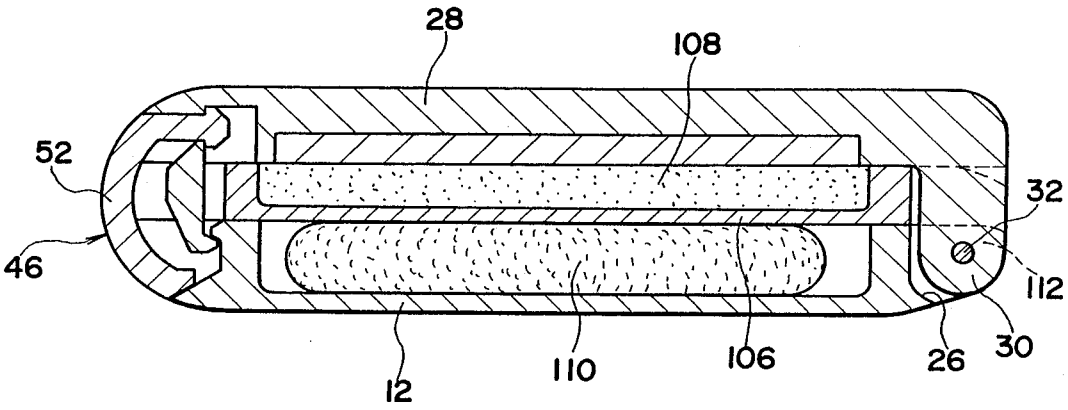
FIG. 18 is a longitudinal section of a vanity case according to a fifth embodiment of the present invention.

As shown in FIG. 18, the vanity case of the present invention may comprise a tray 106 for containing cosmetic material 108 between the cover 28 and receptacle 12 which holds a puff 110. The tray 106 has at its rear end a pair of spaced hinge pieces 112 fitted in the space 26 of the receptacle 12 for connection therewith by the pin 32 which also connects the hinge piece 30 of the cover 28.

Although the present invention has been described with reference to the preferred embodiments thereof, many modifications and alterations may be made within the spirit of the invention.

What is claimed is:

1. A vanity case comprising:

a receptacle member;

a cover member hinged with said receptacle member at the rear end thereof;

a first latch member formed on said receptacle member;

a second latch member formed on said cover member;

said first and second latch members adapted to engage with each other to thereby maintain said cover member in a closed position with respect to said receptacle member;

a cutout formed in the marginal portion of said receptacle member, said cutout being defined by an inner wall and side walls;

a slide member for releasing the engagement between said latch members, said slide member including an upper end and a body having a lower end, said upper end being slidably secured to said cover member, and said body extending downwardly to close said cutout with said lower end abutting said inner wall when said cover member is in said closed position; and a slant surface formed on at least one of said inner wall and said lower end, whereby a sliding movement of said slide member causes said cover member to move upwardly with respect to said receptacle member.

2. A vanity case as claimed in claim 1, further comprising a recess formed in said cover member at a position corresponding to said cutout of said receptacle member, and wherein said upper end of said slide member is slidably fitted in said recess.

3. A vanity case as claimed in claim 2, further comprising a lug extending between the side walls defining said recess and a step formed on the upper surface of said recess, and wherein said upper end of said slide member includes an enlarged head normally engaging with said lug and said step.

4. A vanity case as claimed in claim 3, wherein said lug has a flat upper surface for guiding a sliding movement of said upper end of said slide member.

5. A vanity case as claimed in claim 3, wherein said lug has an inclined upper surface and said step has a length greater than said head, said inclined upper surface and said step cooperating together to permit said slide member to swing while sliding.

6. A vanity case as claimed in claim 4, wherein said second latch member is formed on the lower end of said lug and wherein said first latch member is formed on the inner wall of said cutout.

7. A vanity case as claimed in claim 6, wherein said cutout is formed in the front end of said receptacle member.

8. A vanity case as claimed in claim 1, wherein said cutout is formed in at least one side portion of said receptacle member.

9. A vanity case as claimed in claim 8, further comprising a depression formed in the front end of said receptacle member and a pawl extending downwardly from said cover member, and wherein said first latch member is formed on the inner wall defining said depression.

10. A vanity case as claimed in claim 1, wherein said inner wall of said cutout includes an inclined lower portion forming said slant surface, and wherein said lower end of said slide member normally abuts the lower edge of said slant surface.

11. A vanity case as claimed in claim 1, wherein said inner wall of said cutout includes a projection extending from the lower portion thereof, and wherein said lower end of said slide member has said slant surface abutting the edge of said projection.

12. A vanity case as claimed in claim 1, wherein said body of said slide member has an outer surface arranged to be flush with the outer surfaces of said cover member and said receptacle member when said cover member is in said closed position.

13. A vanity case as claimed in claim 1, further comprising a tray disposed between said receptacle member and said cover member and hinged with said receptacle member at the rear end thereof.

* * * * *